US007004083B2

(12) United States Patent
Ramirez von Holle et al.

(10) Patent No.: US 7,004,083 B2
(45) Date of Patent: Feb. 28, 2006

(54) COLLAPSIBLE INTEGRATED PALLET SYSTEM

(75) Inventors: Sergio Ramirez von Holle, Solvang, CA (US); Alfred Holzheu, Solvang, CA (US)

(73) Assignee: Sergio Ramirez von Holle, Solvang, CA (US)

( * ) Notice: Subject to any disclaimer, the term of this patent is extended or adjusted under 35 U.S.C. 154(b) by 159 days.

(21) Appl. No.: 10/687,350

(22) Filed: Oct. 15, 2003

(65) Prior Publication Data

US 2005/0081763 A1 Apr. 21, 2005

(51) Int. Cl.
*B65D 19/38* (2006.01)

(52) U.S. Cl. ..... 108/57.75; 108/901

(58) Field of Classification Search ..... 108/57.25, 108/57.26, 901, 902, 55.5, 55.3, 51.11
See application file for complete search history.

(56) References Cited

U.S. PATENT DOCUMENTS

| | | | | |
|---|---|---|---|---|
| 4,829,909 | A * | 5/1989 | Mandel | 108/55.5 |
| 5,007,352 | A * | 4/1991 | Calkoen | 108/56.1 |
| 5,197,395 | A * | 3/1993 | Pigott et al. | 108/56.1 |
| 5,337,681 | A * | 8/1994 | Schrage | 108/56.1 |
| 5,413,052 | A * | 5/1995 | Breezer et al. | 108/56.1 |
| 5,417,167 | A * | 5/1995 | Sadr | 108/57.19 |
| 5,456,189 | A * | 10/1995 | Belle Isle | 180/57.17 |
| 5,546,872 | A * | 8/1996 | Young | 108/56.1 |
| RE35,870 | E * | 8/1998 | Durand | 108/56.3 |
| 6,135,031 | A * | 10/2000 | Heil | 108/55.5 |
| 6,216,607 | B1 * | 4/2001 | Cuddy | 108/55.5 |
| 6,357,366 | B1 * | 3/2002 | Frankenberg | 108/57.25 |
| 6,446,563 | B1 * | 9/2002 | Ohanesian | 108/57.25 |
| 6,564,725 | B1 * | 5/2003 | Hale | 108/57.25 |
| 6,837,170 | B1 * | 1/2005 | Taft | 108/57.25 |

FOREIGN PATENT DOCUMENTS

EP 585832 A1 * 3/1994

* cited by examiner

*Primary Examiner*—Jose V. Chen
(74) *Attorney, Agent, or Firm*—Felix L. Fischer

(57) ABSTRACT

The collapsible shipping pallet incorporates a substantially planar deck with multiple stringers removably attached to the bottom of the deck. Shouldered holes arranged in linear spaced relation at predetermined stringer attachment locations on the deck engage resilient slotted pins extending from a top edge each stringer. Multiple slats, each extending perpendicularly to the stringers and removably received in a relief on a bottom edge of each stringer are attached to the stringers also using resilient slotted pins. The stringers support triangular jaws inserted in triangular recesses in an end portion of the stringer to receive and restrain pallet straps. An aperture in the side of the stringer allows insertion of a slotted crank to tension the pallet straps. The deck incorporates slots adapted to receive keys to extend above the surface of the deck engaging receiving slots in a first layer of stacking boxes.

14 Claims, 13 Drawing Sheets

COLLAPSIBLE INTEGRATED PALLET SYSTEM

BACKGROUND OF THE INVENTION

1. Field of the Invention

This invention relates generally to the field of goods transportation pallets and, more particularly, to a collapsible pallet having molded components for field assembly.

2. Description of the Related Art

Most current shipping pallets are of wooden construction having planks or slats attached to wooden stringers with screws or nails. Typically, fabrication of pallets is accomplished at the shipment site and, if pallets are reused, stacking for return of empty pallets consumes significant volume. Wooden pallets are heavy, significantly adding to shipping weight of the goods stacked on the pallets and constituting a heavy load for empty return. Alternative materials such as metals and plastics have been employed for pallet construction to increase durability, however, empty shipping volume remains a significant issue in pallet reuse.

Stacking and retention of loaded goods on existing pallets is typically accomplished by stacking of goods boxes on the pallet and securing the boxes with metal or plastic strapping. Fiberboard or wooden boxes may slip in relation to one another thereby upsetting the loaded pallet. Interlocking box systems such as that disclosed in U.S. Pat. No. 5,497,939 entitled Container with Panel Lock have been developed to partially avoid this problem. However, a pallet system for integrated securing of such containers has not been available.

It is therefore desirable for a pallet to be easily assembled from a collapsed condition promoting volume efficient empty shipping. It is further desirable for a pallet to be constructed of light weight materials for both collapsed and loaded shipping weight reduction.

Additionally, it is desirable for a pallet to incorporate integrated securing features to accommodate interlocking box systems.

SUMMARY OF THE INVENTION

The collapsible shipping pallet of the present invention incorporates a substantially planar deck with multiple stringers removably attached to the bottom of the deck. The deck incorporates shouldered holes arranged in linear spaced relation at predetermined stringer attachment locations. Resilient slotted pins extend from a top edge each stringer, each pin having a shank and an expanded head opposite the top edge of the stringer. Cylindrical collars are inserted into a respective shouldered hole and a flange extending from the body of the collar engages the shoulder of the hole. Each collar has a bore with a first diameter portion sized to receive the shank of a pin and a second diameter portion forming a step to engage the head to constrain the pin in the bore for securing the stringer to the deck.

Multiple slats, each extending perpendicularly to the stringers and removably received in a relief on a bottom edge of each stringer are attached to the stringers also using resilient slotted pins, one pin depending from a top surface of each respective slat relief in each stringer. Each pin has a shank and an expanded head opposite the top surface of the relief. Flanged cylindrical collars as described above are inserted into a respective shouldered hole in a slat to constrain the pin in the bore to secure the slat to the stringer.

The stringers incorporate triangular jaws inserted in triangular recesses in an end portion of the stringer having slots to receive and restrain pallet straps. An aperture in the side of the stringer allows insertion of a slotted crank to tension the pallet straps. The periphery of the deck incorporates slots adapted to receive keys to extend above the surface of the deck engaging receiving slots in a first layer of stacking boxes.

BRIEF DESCRIPTION OF THE DRAWINGS

These and other features and advantages of the present invention will be better understood by reference to the following detailed description when considered in connection with the accompanying drawings wherein.

DETAILED DESCRIPTION OF THE INVENTION

Figure 1:
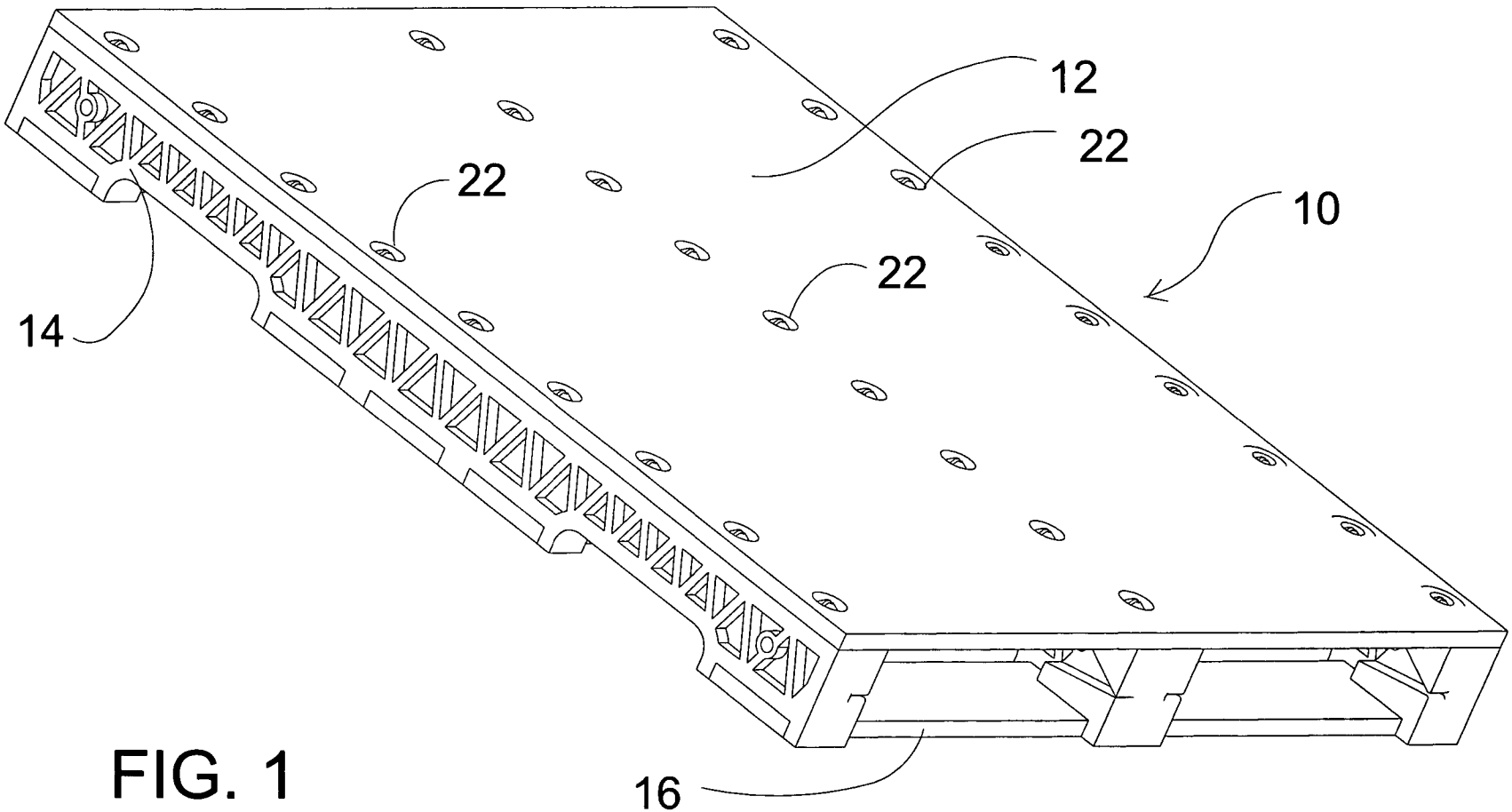
FIG. 1 is a perspective view of deck and side stringer of a pallet embodying the present invention.
Figure 2:
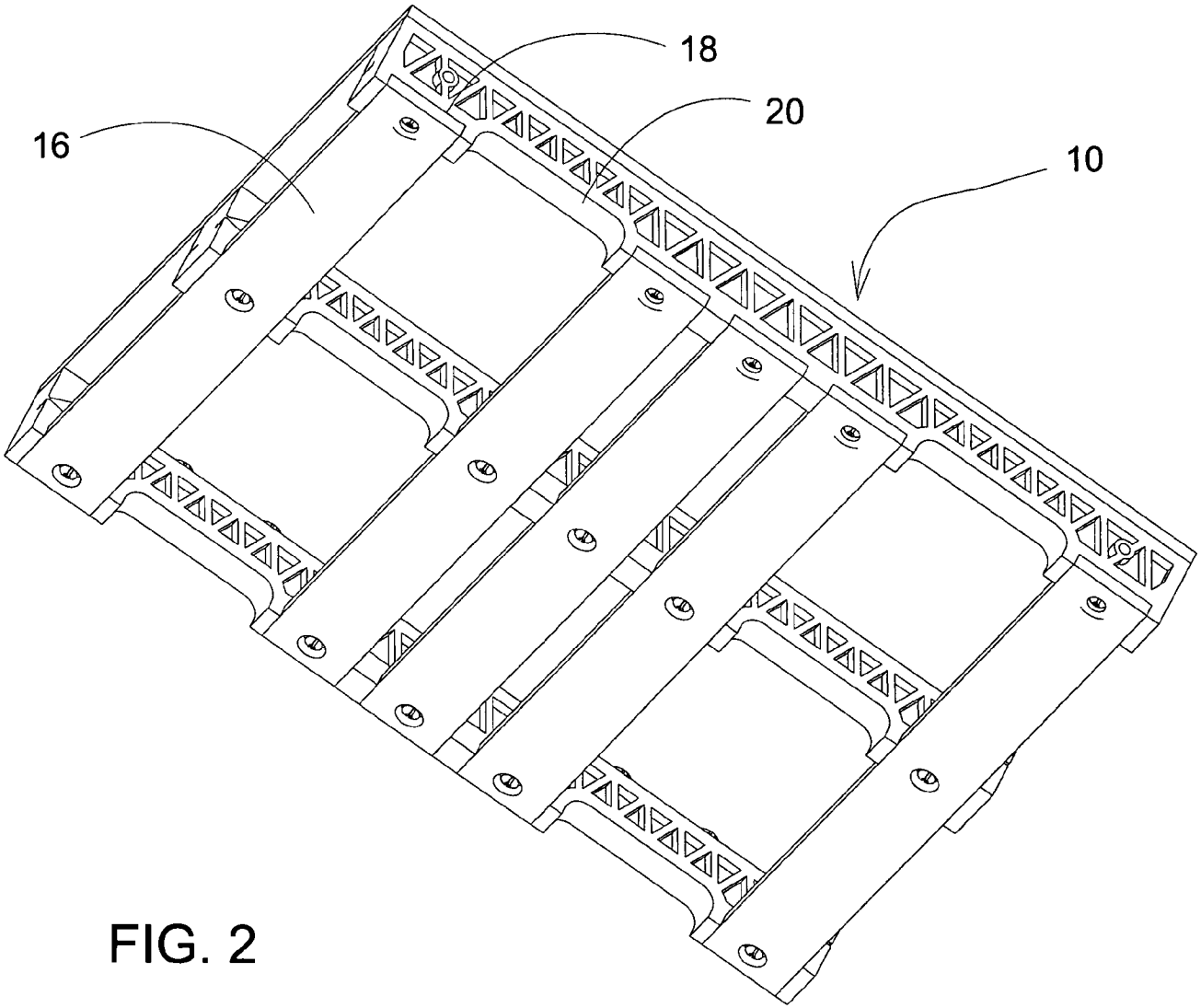
FIG. 2 is a bottom perspective view of the pallet of FIG. 1.

Referring to the drawings, FIG. 1 shows a pallet 10 embodying the present invention. A deck 12 provides the load carrying surface for the pallet. Multiple stringers 14 are removably attached to the bottom surface of the deck. Slats 16 are removably attached to the bottom of the stringers as best seen in FIG. 2. The slats are carried in recesses 18 in the bottom of the stringers. Cutouts 20 are provided in each stringer to accommodate forklift tines for lifting and movement of the assembled and loaded pallet.

Figure 3:
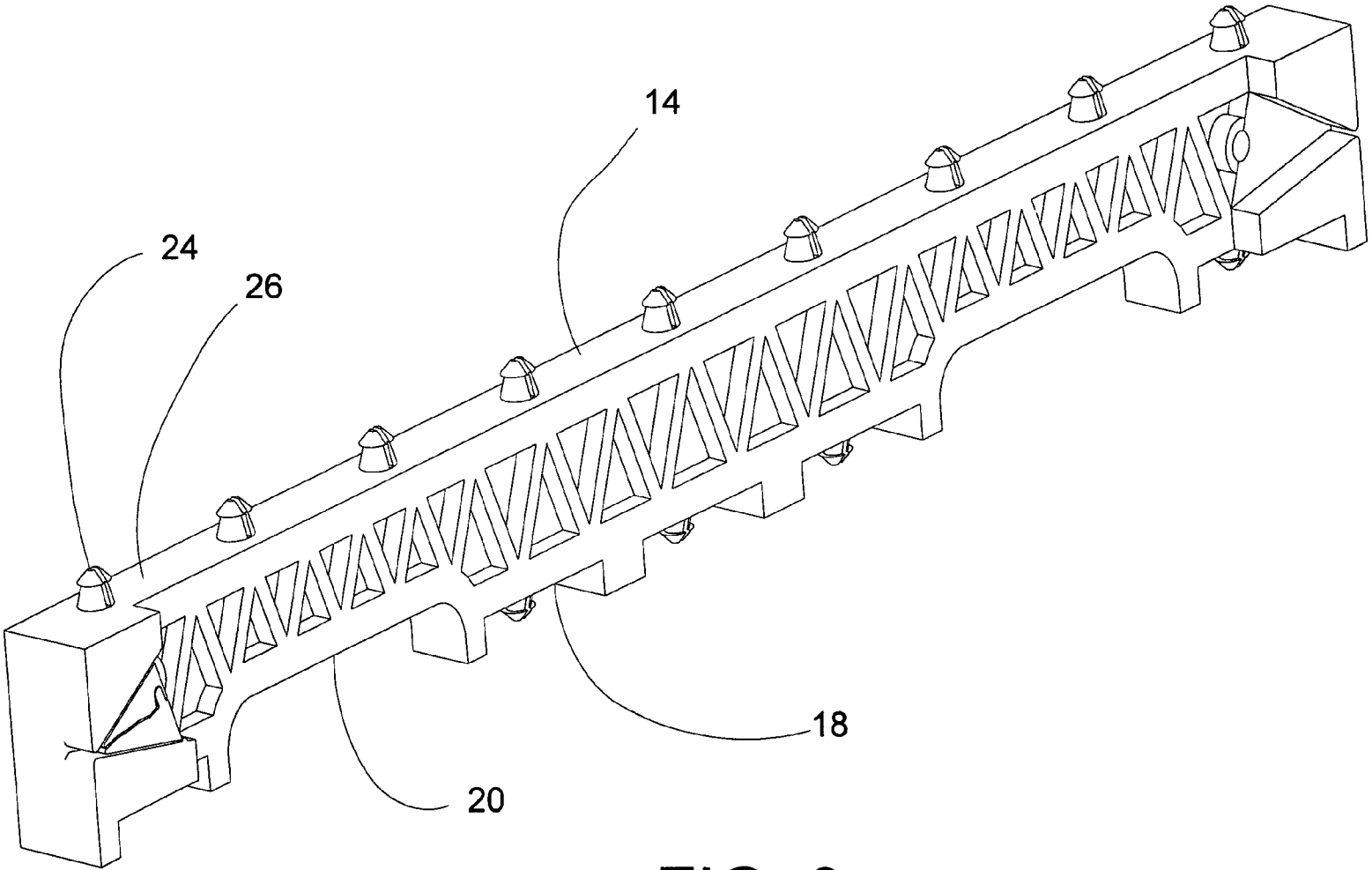
FIG. 3 is an isometric view of one stringer from the pallet of FIG. 1.
Figure 4A:
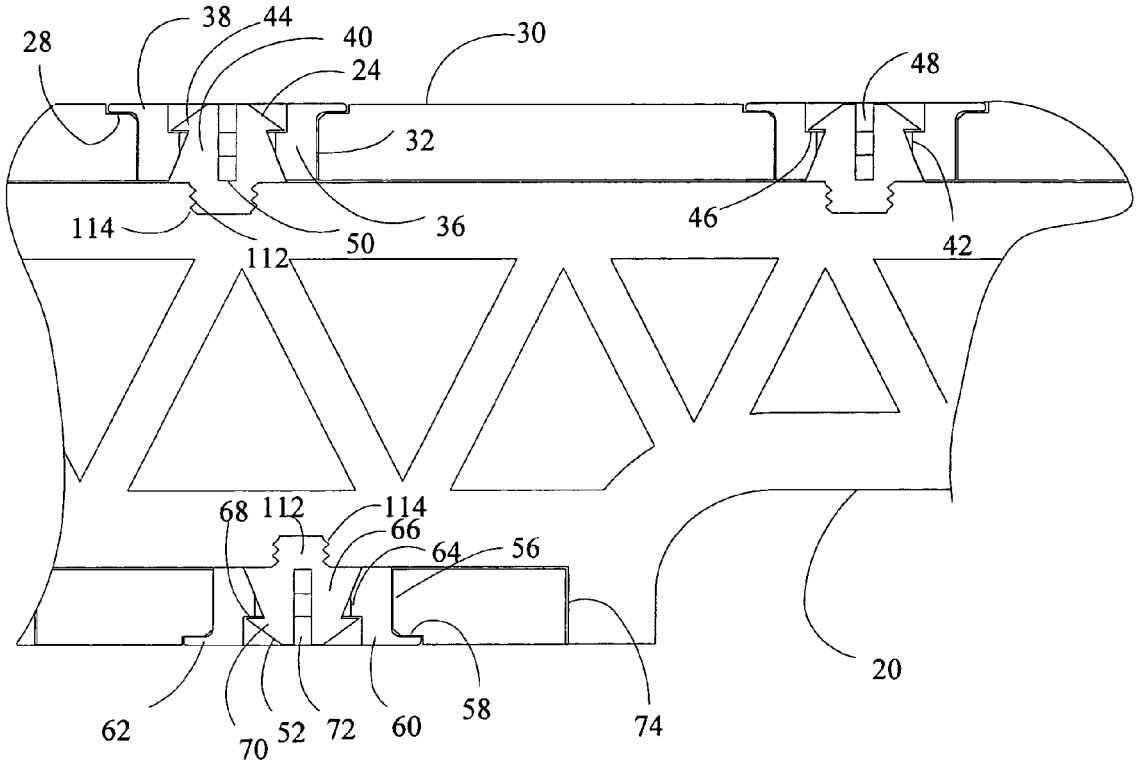
FIG. 4*a* is a partial section view of the deck showing detail of the stringer and slat attachment pins and holes.
Figure 5:
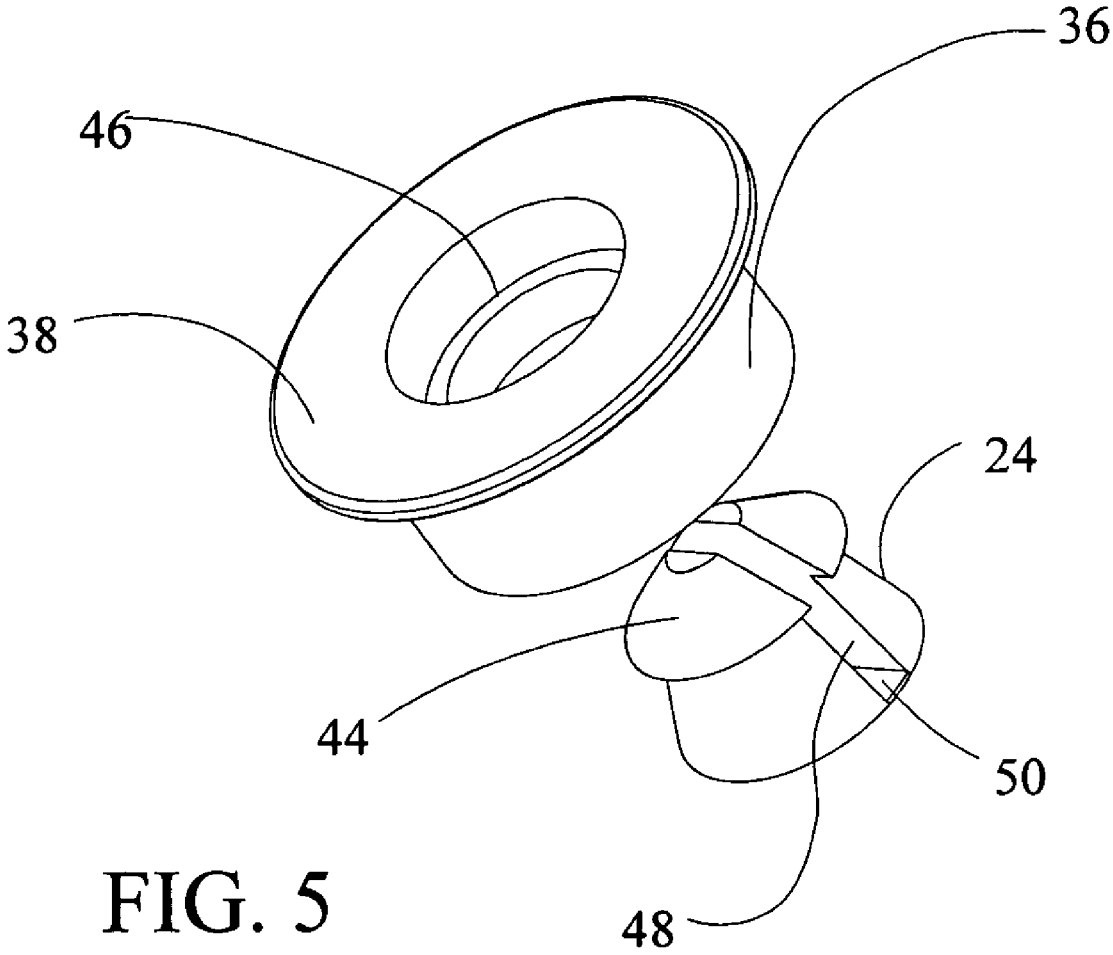
FIG. 5 is an exploded isometric view of a pin and collar employed to secure stringers to the deck and slats to the stringers.

As seen in FIG. 1, the deck incorporates multiple attachment holes 22 for each stringer. As shown in FIG. 3, each stringer has multiple resilient pins 24 extending from a top surface 26. Details of the holes and attachment pins for one embodiment are shown in FIG. 4*a*. Each hole has a shoulder 28 indented from the surface 30 of the deck and a collar bore 32 extending through to the bottom 34 of the deck. The pins on the stringers are received in the holes and a collar 36 is inserted into the hole from the top of the deck with a flange 38 engaging the shoulder of the hole. A shank 40 on each pin is accommodated within a pin bore 42 and a head 44 engages a step 46 in the bore of the collar. Each pin has a slot 48 providing resilience for compression of the head during insertion through the pin bore during assembly. A web 50 at the base of the pin interconnects the sides of the pin body. An exemplary collar and pin are shown in further detail in FIG. 5 as an exploded view.

Figure 4B:
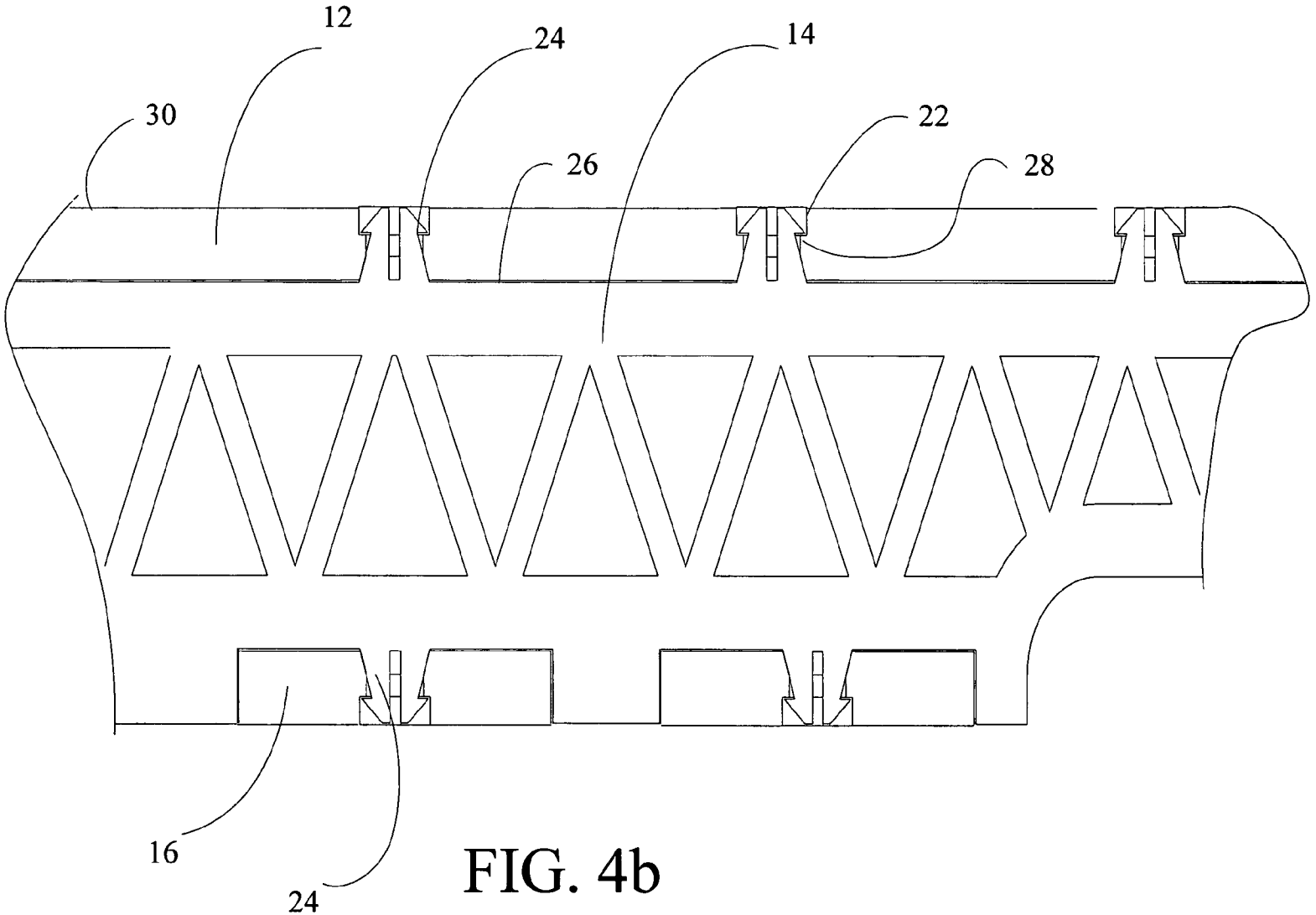
FIG. 4*b* is a partial section view of the deck showing detail of a simplified embodiment of the stringer and slat attachment.

In a simplified embodiment shown in FIG. 4*b*, the collar is not employed and the holes in the deck accommodate the pins directly with the head of the pin engaging the shoulder of the hole with appropriate re-dimensioning of the depth of the shoulder to avoid exposure of the pin head above the deck surface.

Returning to FIG. 3, the slats 16 are attached to the stringers in a manner consistent with the attachment of the stringers to the deck. Pins 52 depending from the stringer are received in holes 54 in each slat. For the embodiment shown, the holes incorporate a collar bore 56 and shoulder 58. A collar 60 having a flange 62 is received in the hole with the flange engaging the shoulder. Each collar has a pin bore 64 which receives a shank 66 of the pin and a step 68 which engages the pin head 70. As with the pins securing the stringers to the deck in the embodiment shown, the pins securing the slats incorporate a slot 72 for resilient deformation of the head during insertion into the collar.

As with the deck hole and pin arrangement, for a simplified embodiment shown in FIG. 4*b*, the collar is not employed for attachment of the slats and the holes in the slats accommodate the pins directly with the head of the pin engaging the shoulder of the hole with appropriate re-dimensioning of the depth of the shoulder to avoid exposure of the pin head below the surface of the slat.

To provide a flat bottom for the pallet, the stringers in the embodiments shown incorporate a relief 76 into which each slat is inserted. The depending pin on the stringer is substantially centered in the relief to engage the slat resulting in a flat skid surface formed by the stringer and slat. To accommodate lifting of the pallet by a forklift, tine cutouts 20, as previously described, are provided in the stringers at two points between slat reliefs.

Figure 6:
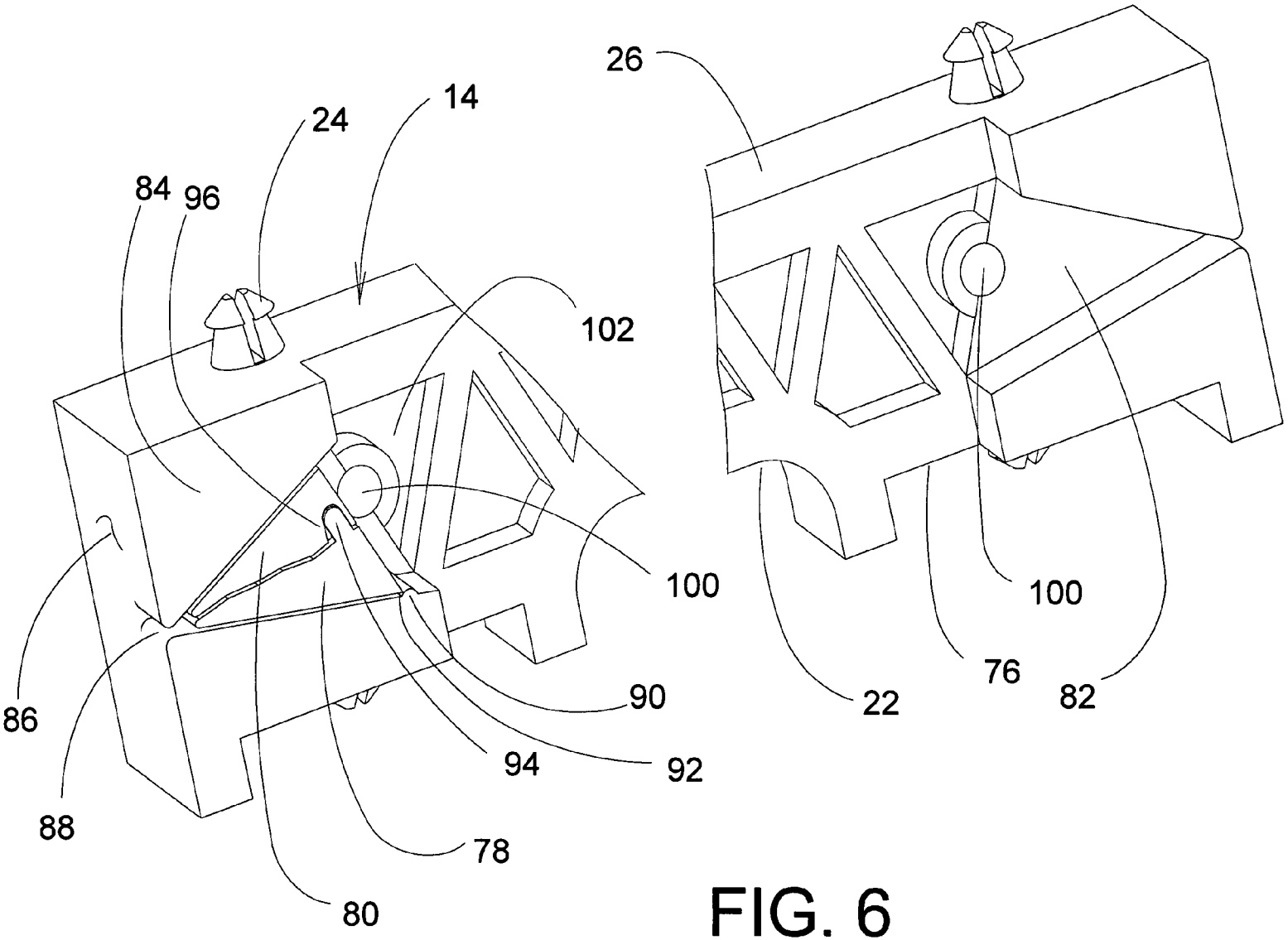
FIG. 6 is a detailed view of the two ends of the stringer of FIG. 3.
Figure 7A:
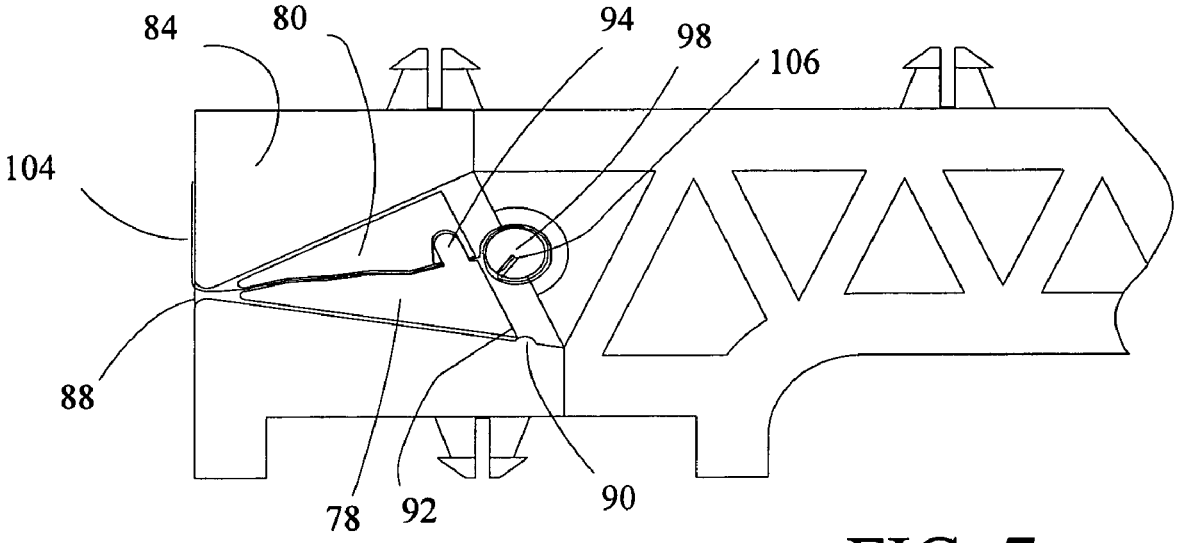
FIG. 7*a* is a top view of the stringer as shown in FIG. 4 with the crank engaged for tightening of the strap.
Figure 7B:
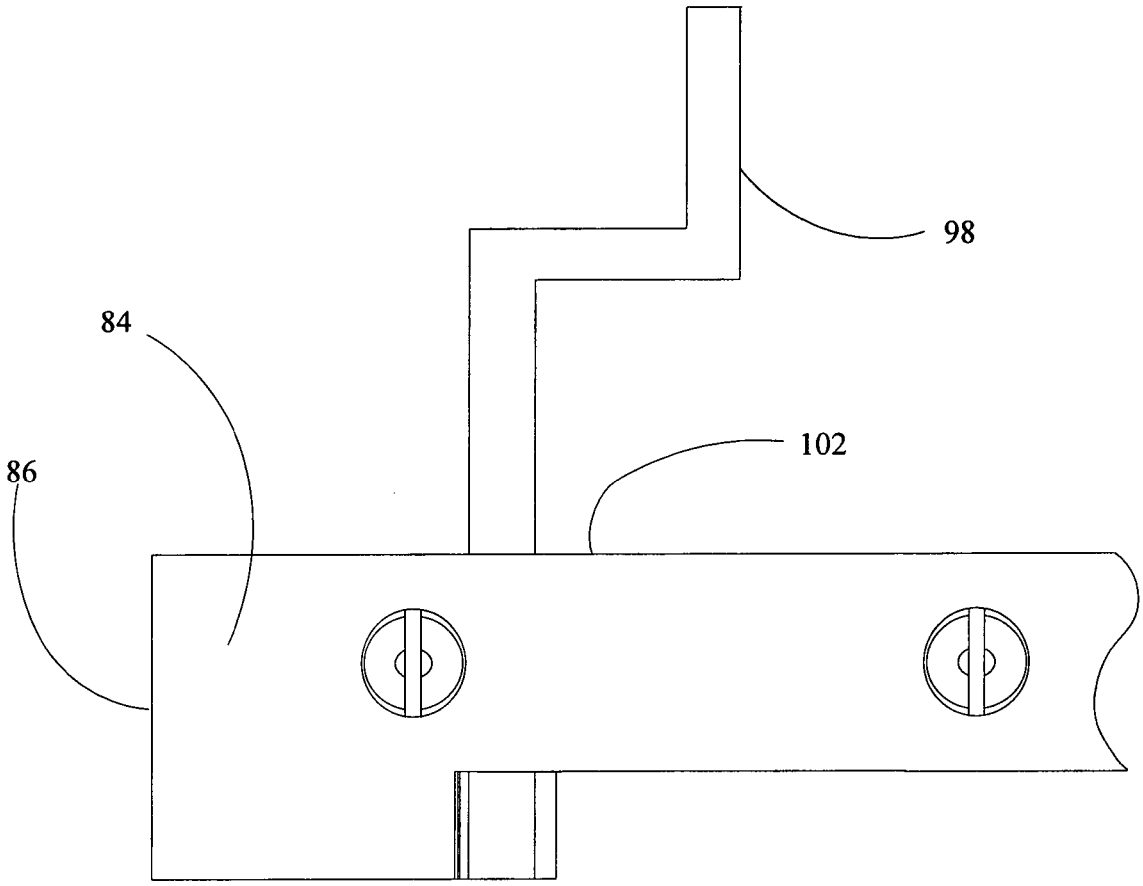
FIG. 7*b* is a side view of the stringer as shown in FIG. 4 with the crank engaged for tightening of the strap.

Integral strap tensioning and securing is accomplished in a pallet incorporating the present invention as shown in FIGS. 6, 7*a* and 7*b*. The stringers incorporate a pair of triangular jaws 78, 80 which are carried in a triangular cutout 82 in an end block 84 on the stringer. The cutout is connected to the end surface 86 of the block through a slot 88. A strap inserted through the slot traverses through the jaws and is frictionally engaged. Withdrawal tension on the strap urges the jaws into the apex of the cutout forcing the jaws together providing greater frictional engagement of the strap to preclude its extraction.

The jaws are constrained in the cutout by an abruption or ridge 90 on the surface of the cutout which engages one edge of the base 92 of the lower jaw 78. A tab 94 on the lower jaw is received in a cutout 96 on the upper jaw 80 to couple the jaws preventing separation or individual movement of one jaw.

Tensioning of the strap is accomplished by a crank 98 which is inserted through an aperture 100 in the side wall 102 of the stringer. A strap 104 is engaged in a slot 106 in the crank. Turning of the crank wraps the strap over itself for frictional engagement with the crank. Once the strap is fully tensioned, backing off on the crank allows the jaws to fully engage the strap reducing strap friction on the crank allowing it to be removed.

To remove the strap upon completion of shipment, several methods are employed. If the strap is disposable, it is merely cut outside the slot and the tail removed from the jaws by drawing it inwardly to release the jaws and allow removal. If the strap is reusable, the crank can be reinserted through the aperture to engage the strap and draw tension to allow disengagement of the jaws which are then removed by laterally translating the jaws from the triangular cutout. Tension on the crank is then released allowing the strap to be withdrawn from the slot. Finally, in certain embodiments, an additional aperture is provide in the stringer adjacent the triangular cutout and the strap slot extends through a side face of the end block of the stringer. A flat faced pin driven through the additional aperture forces lateral translation of the jaws and strap from the cutout and slot respectively. The jaws are then removed from the strap and replaced in the cutout.

To accommodate breakage of the pins on the stringers, alternative embodiments of the invention employ removable pins. In one embodiment shown in FIG. 4*a*, the pin incorporates a threaded portion 112 on the shank opposite the head. The threaded portion is received in a threaded bore 114 in the stringer. The slot in the pin allows a flat bladed tool to be used for insertion or removal of the pin from the stringer.

Figure 8:
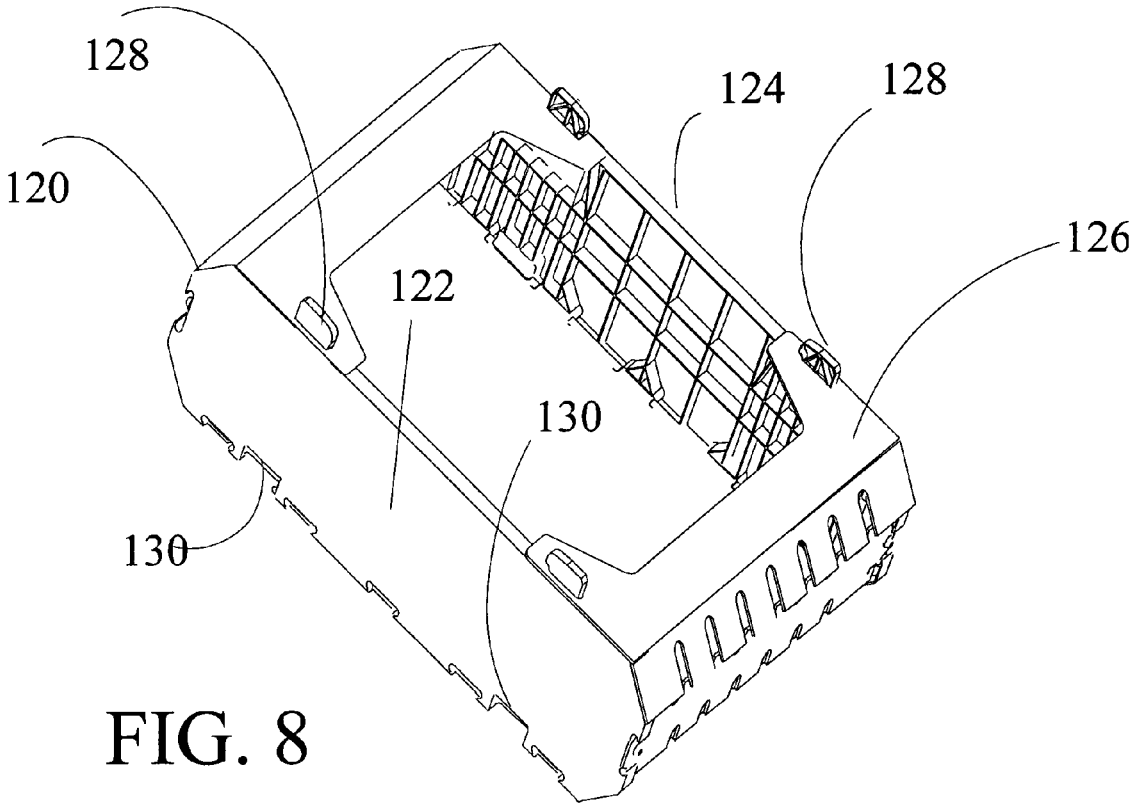
FIG. 8 is an isometric view of a self-engaging box for use with the pallet system of the present invention.
Figure 9:
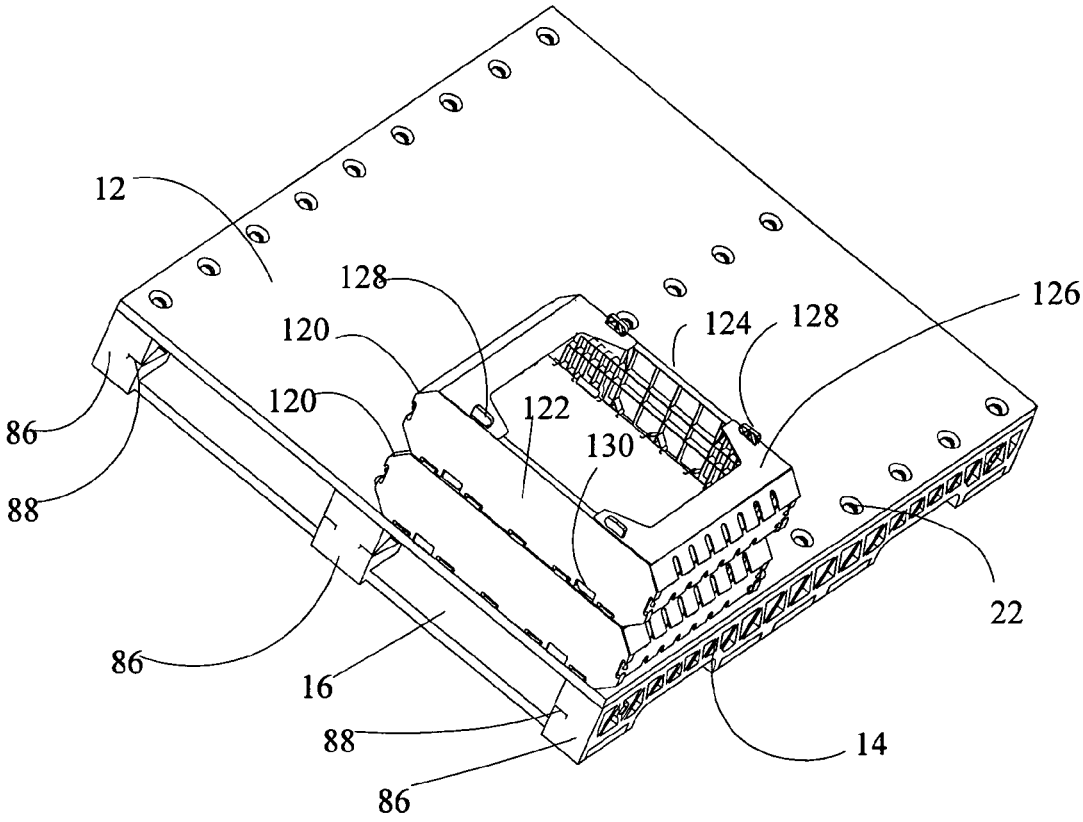
FIG. 9 is a partial perspective view of the assembled pallet incorporating the present invention loaded with the boxes of FIG. 8.

Pallets incorporating the present invention are particularly useful with self stacking containers such as that disclosed in U.S. Pat. No. 5,497,939 entitled Container with Panel Lock, owned by the assignee of the present invention, the disclosure of which is incorporated herein by reference as though fully set forth. As shown in FIG. 8 a container 120 having end plates 122, 124 and a folded panel 126 constrained by the end plates, employs stacking tabs 128 extending from the upper surface of each end plate. The stacking tabs are engaged in receiving slots 130 in the end plates of a second container stacked on top of the first container as shown in FIG. 9.

Figure 10A:
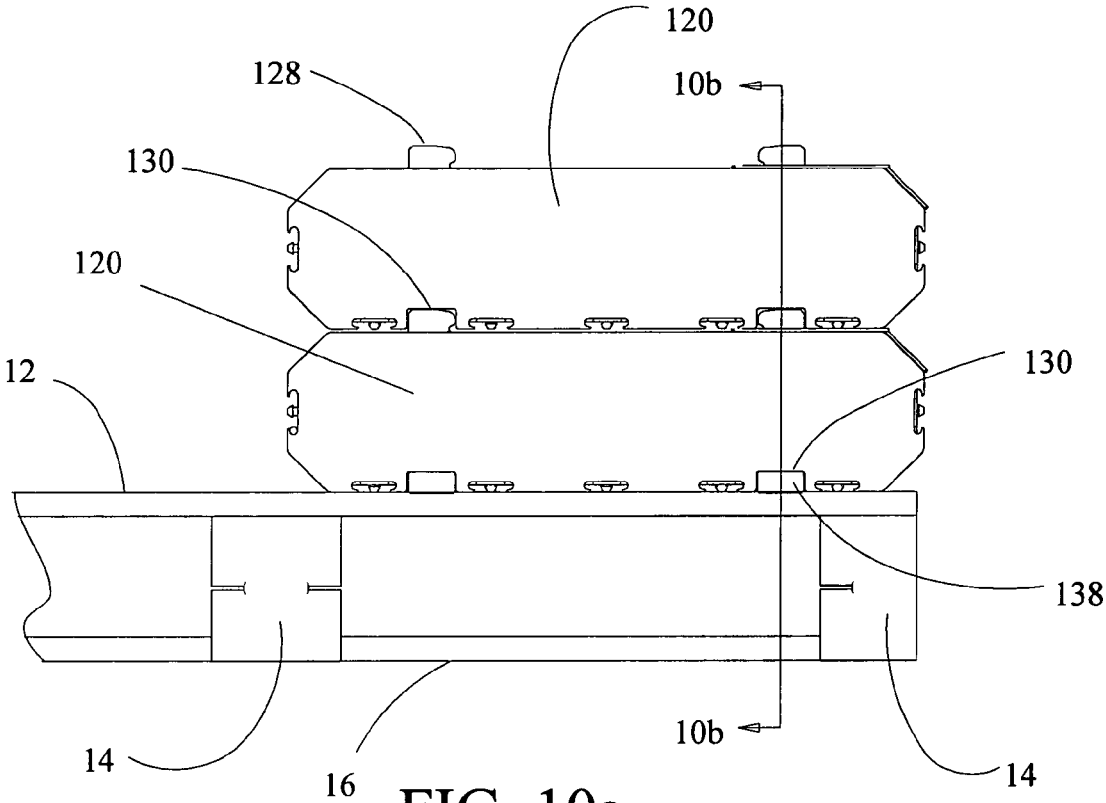
FIG. 10*a* is an elevation view of the pallet with two stacked boxes.
Figure 10B:
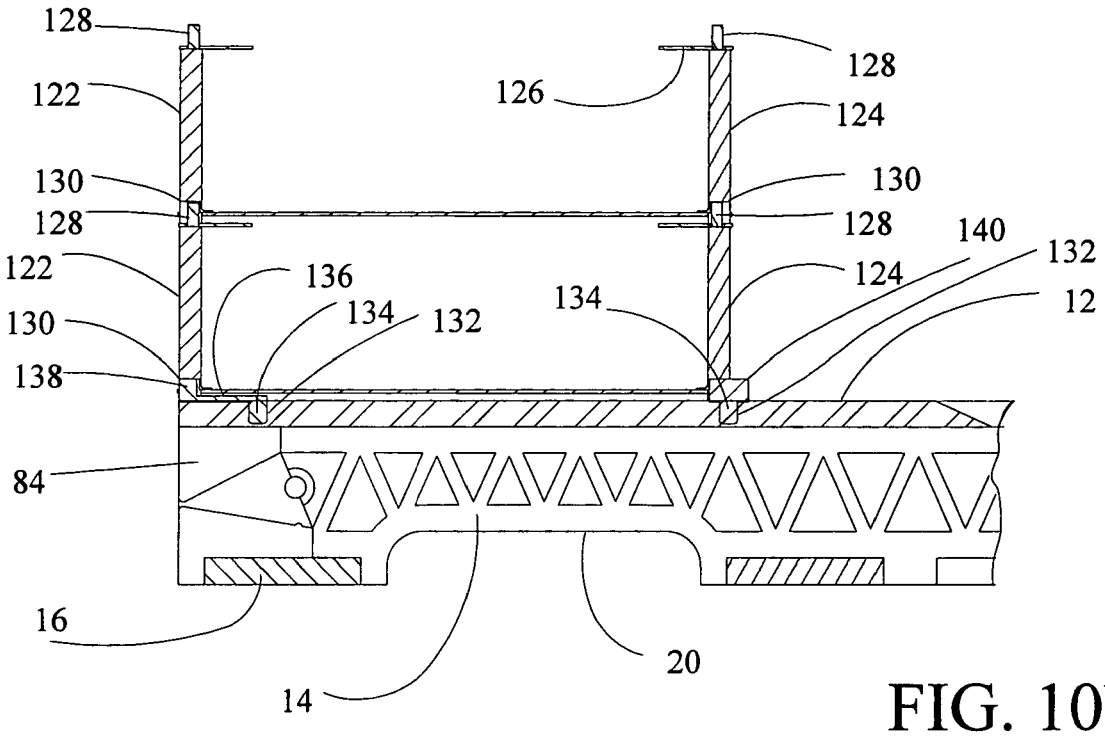
FIG. 10*b* is a detailed sectional elevation view, taken along line 10*b*—10*b* in FIG. 10*a*, showing the box engagement slots in the deck with associated keys.

As detailed in FIGS. 10*a* and 10*b*, the deck incorporates key slots 132 positioned in spaced relationship to accommodate blade keys 134 which are then received in the receiving slots of the bottom layer of stacked containers when loaded onto the deck thereby precluding slippage or shifting of the containers on the pallet deck. For the embodiment shown in the drawings, the blade keys have two configurations. A first configuration is employed for slots adjacent the edge of the pallet wherein the key 134 is attached through a horizontal web 136 to the engagement tab 138 received in the receiving slot 130 in the box. This allows the stacking of boxes at the edge of the pallet with the key slot displaced from the periphery of the pallet deck. The box constrains the web ensuring that the key remains engaged in the slot. The second configuration of key is used on interior slots on the pallet and employs an elongated tab 140 mounted on the key which engages the receiving slots of two adjacent boxes. The pallet and containers then provide a complete shipment system with integral interconnection to provide a rigid structure precluding load shifting or slippage.

The blade keys are removable to allow use of the pallet with a flat surface if desired and for volume reduction in stacking assembled or collapsed pallets. Alternatively, for pallet shipment, the interior keys are in place in the interior key slots of a first pallet deck with a second pallet deck inverted for stacking receiving the keys in their respective key slots to engage the two decks.

Having now described the invention in detail as required by the patent statutes, those skilled in the art will recognize modifications and substitutions to the specific embodiments disclosed herein. Such modifications are within the scope and intent of the present invention as defined in the following claims.

What is claimed is:

1. A collapsible shipping pallet comprising:

a substantially planar deck;

a plurality of stringers removably attached to a bottom of the deck, at least one of the stringers having integral means for restraining pallet straps located proximate at least one end of the stringer and wherein the deck incorporates a second plurality of shouldered holes located in the deck and arranged in linear spaced relation at predetermined stringer attachment locations;

means for attaching the plurality of stringers having a third plurality of resilient slotted pins extending from a top edge each stringer, each pin having a shank and an expanded head distal the top edge of the stringer; and a plurality of substantially cylindrical collars equal in number to the second plurality, each collar having a body inserted into a respective shouldered hole and a flange extending from the body engaging the shoulder of the respective hole, each collar further having a bore therethrough, the bore having a first diameter portion sized to receive the shank of a respective pin and a second diameter portion forming a step, the second diameter portion receiving the head of the pin with the step engaging the head to constrain the pin in the bore.

2. A collapsible shipping pallet as defined in claim 1 further comprising a fourth plurality of slats, each slat extending perpendicularly to the stringers and removably attached to a bottom edge of each stringer and means for attaching the slats to the stringers having a fourth plurality of resilient slotted pins, one pin depending from each stringer to engage a respective slat, each pin having a shank and an expanded head distal the stringer; and a plurality of substantially cylindrical collars, each collar having a body inserted into a respective shouldered hole in a slat and a flange extending from the body and engaging the shoulder of the respective hole, each collar further having a bore therethrough, the bore having a first diameter portion sized to receive the shank of a respective pin and a second diameter portion forming a step, the second diameter portion receiving the head of the pin with the step engaging the head to constrain the pin in the bore.

3. A collapsible shipping pallet as defined in claim 2 wherein each slat is received in a relief on the bottom surface of the stringer and the pin depends from a top surface of each respective slat relief in the stringer.

4. A collapsible shipping pallet as defined in claim 1 wherein the restraining means comprises:

a jaw pair having a substantially triangular cross section, the jaws bifurcated between an apex and a base, the jaw pair received in a triangular cutout in an end portion of the at least one stringer, the end portion further having a slot extending through a first side wall of the end portion to an apex of the cutout for the pallet strap to extend therethrough, the pallet strap further extending through the bifurcation in the jaws and, under tension, frictionally urging the jaws into the triangular cutout.

5. A collapsible shipping pallet as defined in claim 4 wherein the triangular cutout abuts a restraint distal the apex, the restraint engaging the base of the jaw pair to prevent translation away from the cutout apex.

6. A collapsible shipping pallet as defined in claim 4 wherein a first element of the jaw pair incorporates a hinge tab received in a hinge cutout in a second element of the jaw pair to preclude separation of the jaw pair.

7. A collapsible shipping pallet as defined in claim 4 wherein the at least one stringer further includes an aperture in a second side wall perpendicular to the first side wall, the aperture proximate a base of the triangular cutout and further comprising a crank having a slotted shaft received through the aperture for engagement of the pallet strap for tensioning upon rotation of the crank.

8. A collapsible shipping pallet as defined in claim 1 wherein the slot in each slotted pin originates at the head and extends through the shank of the pin to a web.

9. A collapsible shipping pallet as defined in claim 1 wherein the deck incorporates a plurality of key slots positioned in spaced relation to receiver slots on stackable containers to be carried on the deck and further comprises blade keys received in the key slots for engagement of the receiver slots on the stackable containers.

10. A method for assembly and use of a collapsible shipping pallet comprising the steps of:

providing a substantially planar deck incorporating a plurality of shouldered holes located in the deck and arranged in linear spaced relation at predetermined stringer attachment locations;

assembling stringers having resilient slotted pins extending from a top edge each stringer to a bottom of the deck, each pin having a shank and an expanded head distal the top edge of the stringer to the deck by inserting the pins through the holes in the deck;

fastening the stringers to the deck using cylindrical collars having a body inserted into a respective shouldered hole and a flange extending from the body engaging the shoulder of the respective hole, each collar further having a bore therethrough, the bore having a first diameter portion sized to receive the shank of a respective pin and a second diameter portion forming a step, the second diameter portion receiving the head of the pin with the step engaging the head to constrain the pin in the bore, the head of the resilient pin deforming for receipt into the bore of the collar and expanding to engage the shoulder.

11. A method for assembly and use of a collapsible shipping pallet as defined in claim 10 further comprising the steps of:

assembling slats to the stringers wherein each slat extends perpendicularly to the stringers and is removably received in a relief on a bottom edge of each stringer, each slat further has a plurality of shouldered holes receiving resilient slotted pins, one pin depending from a top surface of each respective slat relief in each stringer, each pin having a shank and an expanded head distal the top surface of the relief;

fastening the slats to the stringers using cylindrical collars having a body inserted into a respective shouldered hole and a flange extending from the body engaging the shoulder of the respective hole, each collar further having a bore therethrough, the bore having a first diameter portion sized to receive the shank of a respective pin and a second diameter portion forming a step, the second diameter portion receiving the head of the pin with the step engaging the head to constrain the pin in the bore, the head of the resilient pin deforming for receipt into the bore of the collar and expanding to engage the shoulder.

12. A method for assembly and use of a collapsible shipping pallet as defined in claim 11 further comprising the steps of:

loading material to be shipped onto the deck;

routing the pallet strap over the shipped material;

inserting a crank having a slotted shaft through an aperture in a second side wall perpendicular to the first side wall, the aperture proximate a base of the triangular cutout in the at least one stringer for engagement of the pallet strap;

inserting the strap through the slot in the stringer first side wall and through the bifurcation in the jaws into the slot on the crank; and, tensioning the strap by rotating the crank, the strap under tension frictionally urging the jaws into the triangular cutout to lock the strap upon release of tension on the crank.

13. A method for assembly and use of a collapsible shipping pallet as defined in claim 10 further comprising the steps of:

inserting a jaw pair having a substantially triangular cross section, the jaws bifurcated between an apex and a base, into a triangular cutout in an end portion of at least one stringer, the end portion further having a slot extending through a first side wall of the end portion to an apex of the cutout for a pallet strap to extend therethrough.

14. A method for assembly and use of a collapsible shipping pallet as defined in claim 10 wherein the deck incorporates a plurality of key slots and further comprising the steps of:

inserting blade keys into the key slots; and loading self stacking containers having receiving slots on a bottom surface thereof onto the deck with the blade keys being engaged by the receiving slots.

* * * * *